United States Patent [19]

Klimin et al.

[11] 4,107,564

[45] Aug. 15, 1978

[54] PHOTOEMITTER

[76] Inventors: Alexandr Ivanovich Klimin, Gradhdansky prospekt, 110, korpus 1, kv. 71; Alexandr Alexeevich Mostovsky, Svetlanovsky prospekt, 35, kv. 19; Rafail Lvovich Nemchenok, Bolshaya Pushkarskaya ulitsa 44, kv. 27, all of Leningrad, U.S.S.R.

[21] Appl. No.: 579,227

[22] Filed: May 20, 1975

[30] Foreign Application Priority Data

May 21, 1974 [SU] U.S.S.R. ..... 2025744

[51] Int. Cl.[2] ..... H01J 39/00; H01J 39/06

[52] U.S. Cl. ..... 313/94; 313/385

[58] Field of Search ..... 313/94, 366, 384, 385, 313/386; 252/62.3 ZB

[56] References Cited

U.S. PATENT DOCUMENTS

| | | | |
|---|---|---|---|
| 3,140,998 | 7/1964 | Folberth | 252/62.3 ZB |
| 3,259,582 | 7/1966 | Folberth | 252/62.3 ZB |
| 3,631,303 | 12/1971 | Antypas et al. | 313/94 |
| 3,687,743 | 8/1972 | Le Duc | 252/62.3 ZB |
| 3,806,372 | 4/1974 | Sommer | 313/366 X |

*Primary Examiner*—Robert Segal

*Attorney, Agent, or Firm*—Lackenbach, Lilling & Siegel

[57] ABSTRACT

A photoemitter sensitive in the optical range of wavelengths comprises, according to the invention, a substrate made from p-type semiconductor materials of a group of chemical compounds $A^{II}B^{IV}C_2^{V}$, where $A^{II}$ are elements belonging to the second subgroup of group II: zinc and cadmium, $B^{IV}$ are elements belonging to the second subgroup of group IV: germanium, silicon and tin, $C_2^{V}$ are elements belonging to the second subgroup of group V: phosphorus and arsenic, and a coating of cesium and oxygen. Homogeneity of the bulk and surface properties of the emitter substrate provides high sensitivity in the near-threshold region of photosensitivity corresponding to the width of the forbidden band of the photoemitter substrate.

4 Claims, 1 Drawing Figure

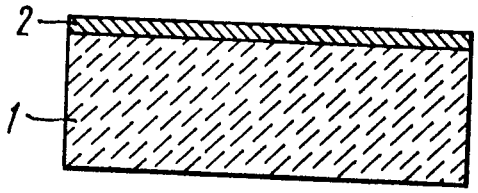
2
1

PHOTOEMITTER

The invention relates to electronic devices and more particularly to photoemitters.

The invention can be used in photoelectronic devices, for example, in vacuum photocells and photomultipliers, and in television camera tubes.

Extensively used have recently become photocathodes made of p-type semiconductor materials with the surface thereof activated to the negative electron affinity state by a thin film adsorbed thereon. In the negative electron affinity state the level of the bottom of a conduction in the depth of the conductor is above the vacuum level. This is achieved through the effective reduction in the electron work function due to adsorption in the activating thin film and through formation of a negative space charge in the surface layer of the conductor. The latter circumstance causes bending of energy bands in the conductor surface layer and the energy level of the conduction band bottom at the surface of the semiconductor becomes lower than the vacuum energy level. In photoemitters with negative electron affinity electrons emitted in the bulk under the effect of light move from the valence band of the base to the bottom of the conduction band and fly off into the vacuum.

It is known that to be an effective photoelectron emitter with negative electron affinity, a semiconductor material must meet certain requirements, namely:

1. The material must possess p-type conduction due to a single impurity;

2. The material must have a large length of minority carrier diffusion;

3. The depth of electron emission must not be less than the depth of light penetration into the conductor for a more complete use of light absorbed in the semiconductor.

Besides, the efficiency of emission from photocathodes with negative electron affinity, particularly in the near-threshold range of spectral sensitivity, depends on the band structure of the semiconductor. Emission efficiency is higher for semiconductors with coincident extrema of the valence band and the conduction band. These requirements are met by certain semiconductor compounds of the type $A^{III}B^{V}$, where $A^{III}$ is a chemical element from the second subgroup of the third group, and $B^{V}$ is an element from the second subgroup of the fifth group in the periodic table, for instance, gallium arsenide single crystals and layers coated with a cesium oxide layer. Negative electron affinity obtained, for example, for gallium phosphide does not provide such a high emission efficiency in the near-threshold range of spectral sensitivity, as the extrema of the valence band and the conduction band do not coincide in gallium phosphide.

Known in prior art is a photoemitter of an electron discharge tube which contains a semiconductor material substrate and a coating of an alkali metal and oxygen activating the surface of the substrate. The p-type semiconductor material is, for instance, GaAs belonging to compounds type $A^{III}B^{V}$ or a GaAs solid solution with an admixture of GaP or GaSb. None of $A^{III}B^{V}$ compounds, except GaSb, can be used for producing emitters sensitive to the long-wave portion of the spectrum. However, it is technologically difficult to employ GaSb for the purpose because of its low melting point (712° C).

The use of solid solutions as a substrate is dictated by the need of producing emitters sensitive to the long-wave part of the spectrum. It is, however, difficult to produce solid solutions of the same volume and surface, one of the reasons being, for example, non-equilibrium crystallization which requires a search for technological ways of homogenization.

Non-homogeneity of solid solutions affects adversely the bulk properties of the emitter substrate, since it reduces the diffusion length of minority carriers, and the properties of a pure surface which determine the emission efficiency of the activating coating. In order to obtain a pure surface of solid solutions, the emitter substrate must be heated to high temperatures approaching the solid solution decomposition point, prior to applying an activating coating onto the substrate. This heating may cause a transition of the most volatile component of the solution to a gaseous phase.

It is on object of the invention to provide a photoemitter sensitive to the optical wavelengths range and having a substrate made of a material with more homogeneous properties and a higher resistance to the effect of temperatures.

This object is accomplished by a photoemitter sensitive to an optical range of wavelengths comprising a substrate of a semiconductor material which emits electrons under the influence of this radiation and a coating applied to one of the substrate surfaces reducing the work function of the electrons and activating the surface of the substrate to an effective negative electron affinity state, wherein, according to the invention, the substrate is made of p-type semiconductor materials belonging to a $A^{II}B^{IV}C_2^{V}$ group of chemical compounds in the periodic table, where $A^{II}$ are chemical elements selected from the second subgroup of group II consisting of Zn and Cd, $B^{IV}$ are chemical elements from the second subgroup of group IV composed of Ga, Si, Sn, and $C^{V}$ are chemical elements from the second subgroup of group V composed of P and As.

It is preferable that a photoemitter has a substrate made of p-type semiconductor material $ZnGeP_2$.

It is also preferable that a photoemitter has a substrate made of p-type semiconductor material $CdSnP_2$.

It is advisable that a photoemitter has a substrate made of p-type semiconductor material $CdSnAs_2$.

The present invention renders it possible to make a substrate of a photoemitter from chemical compounds of $A^{II}B^{IV}C_2^{V}$ type which have more homogeneous properties and a higher resistence to the effect of high temperatures. This simplifies the technology of manufacturing a photoemitter and increases the production of serviceable vacuum tubes.

The invention is illustrated in the accompanying drawing which shows a longitudinal sectional view of a photoemitter according to the invention.

A proposed photoemitter comprises a substrate I made from a p-type semiconductor material of a $A^{III}B^{IV}V_2^{V}$ group of chemical compounds, for example, $ZnGeAs_2$, and an activating coating 2 made of cesium and oxygen.

The substrate I of the emitter made from chemical compounds type $A^{III}B^{IV}C_2^{V}$ is produced using one of the known techniques /"Semiconductors $A^2B^4C^5$," edited by N.A.Goryunova, Yu.A.Valov, M.,Sovyetskoye Radio, 1974/.

To obtain an effective photoemitter with negative electron affinity the emitter substrate is heated in superhigh vacuum to temperatures below the compound decomposition point. After heating, the purity and quality of the surface are checked using the known methods of slow electron diffraction and Auger-electron spectroscopy. A pure surface of the substrate I is activated by the coating 2 made of an alkali metal, for example, cesium and oxygen until negative electron affinity is obtained. Negative electron affinity is checked by measuring the spectral sensitivity of the emitter at a wavelength close to the width of the forbidden band of the semiconductor substrate I and also by measuring the electron work function.

The invention can be more fully understood from the following detailed description of preferred embodiments thereof.

EXAMPLE 1

A p-type $ZnGeP_2$ crystal with an acceptor concentration of the order of $5.10^{18}$ I/cm$^3$ serving as the substrate I of a photoemitter is disposed inside a vacuum discharge tube at a pressure not over $5.10^{-8}$ mm Hg, heated to about 600° C and after cooling down to 20° C is activated by cesium adsorbable on the surface of the base, the spectral sensitivity of the emitter being checked at a wavelength of 550 millimicrons. The photoemitter produced thereby is an emitter with negative electron affinity and has spectral sensitivity at a wavelength of 580 millimicrons which is I per cent of the maximum lying in the 400-millimicron range. The basic abrupt rise of spectral sensitivity occurs in the range from 590 to 540 millimicrons.

EXAMPLE 2

A p-type $ZnSiAs_2$ crystal with an acceptor concentration of at least $10^{18}$ I/cm$^3$ serving as the substrate I of a photoemitter is disposed inside a vacuum discharge tube at a pressure not over $5.10^{-8}$ mm Hg, heated to about 600° C and after cooling down to 20° C is activated by cesium adsorbable on the surface of the substrate I, the spectral sensitivity of the photoemitter being checked at a wavelength of 550 millimicrons. The photoemitter produced thereby is an emitter with negative electron affinity and has spectral sensitivity at a wavelength of 560 millimicrons which is I per cent of the maximum lying in the 400-millimicron range.

The main abrupt rise of spectral sensistivity occurs in the range from 580 to 530 millimicrons.

EXAMPLE 3

A p-type $CdSnP_2$ crystal with an acceptor concentration of the order of $10^{19}$ I/cm$^3$ serving as the substrate I of a photoemitter is disposed inside a vacuum discharge tube at a pressure not over $10^{-8}$ mm Hg, heated to about 600° C and after cooling down to 20° C is activated by cesium and oxygen adsorbable on the surface of the substrate I, the spectral sensitivity of the photoemitter being checked at a wavelength of 750 millimicrons. The photoemitter produced thereby is an emitter with negative electron affinity and has spectral sensitivity at a wavelength of 830 millimicrons which is I per cent of the maximum lying in the 550-millimicron range. The main abrupt rise of spectral sensitivity occurs in the range from 830 to 770 millimicrons.

In the examples given above the main abrupt rise of spectral sensistivity in a relatively narrow wavelength interval is provided by homogeneous bulk properties and a pure surface of the substrate I made of a chemical compound type $A^{II}B^{IV}C_2^{V}$.

The proposed photoemitter sensitive to the optical wavelength range of luminous radiation has a homogeneous temperature-resistant substrate I and displays higher photosensitivity in its near-threshold region which is provided by negative electron affinity.

What is claimed is:

1. A photoemitter sensitive in the optical wavelength range of the light spectrum, comprising:
   a. a substrate which emits electrons under the influence of said light radiation;
   said substrate is made of p-type semiconductor materials belonging to a group of chemical compounds $A^{II}B^{IV}C_2^{V}$ in the periodic table, where $A^{II}$ are chemical compounds selected from the second subgroup of group II and consisting of Zn and Cd, $B^{IV}$ are elements selected from the second subgroup of group IV and comprising Ge, Si, Sn, and $C^{V}$ are elements selected from the second subgroup of group V and comprising P and As;
   b. one surface of said substrate;
   c. a coating applied to said one surface of said base intended to reduce the electron work function and activating said surface of said substrate to the effective negative electron affinity state.

2. A photoemitter as of claim 1, wherein said substrate is made of p-type semiconductor material $ZnGeP_2$.

3. A photoemitter as of claim 1, wherein said substrate is made of p-type semiconductor material $ZnSiAs_2$.

4. A photoemitter as of claim 1, wherein said substrate is made of p-type semiconductor material $CdSnP_2$.

* * * * *